US009389569B2

(12) United States Patent
Ishikawa

(10) Patent No.: US 9,389,569 B2
(45) Date of Patent: Jul. 12, 2016

(54) IMAGE FORMING APPARATUS

(71) Applicant: FUJI XEROX CO., LTD., Minato-ku, Tokyo (JP)

(72) Inventor: Takatoshi Ishikawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 83 days.

(21) Appl. No.: 14/025,288

(22) Filed: Sep. 12, 2013

(65) Prior Publication Data

US 2014/0199104 A1 Jul. 17, 2014

(30) Foreign Application Priority Data

Jan. 11, 2013 (JP) ..... 2013-003459

(51) Int. Cl.
*G03G 15/00* (2006.01)

(52) U.S. Cl.
CPC .. *G03G 15/6558* (2013.01); *G03G 2215/00409* (2013.01)

(58) Field of Classification Search
CPC ..... G03G 15/6558; G03G 15/6555; G03G 2215/0154; G03G 2215/00248; G03G 2215/00481; G03G 2215/00561; G03G 2215/00565; G03G 2215/00409; G03G 2215/00675
See application file for complete search history.

(56) References Cited

U.S. PATENT DOCUMENTS

2007/0029717 A1* 2/2007 Mori ..... 271/8.1
2009/0208259 A1* 8/2009 Ishikawa ..... 399/313
2012/0275829 A1* 11/2012 Nishida et al. ..... 399/313

FOREIGN PATENT DOCUMENTS

JP 2011-123399 A 6/2011
JP 2012230273 A * 11/2012 ..... G03G 15/16

OTHER PUBLICATIONS

Communication dated Dec. 1, 2015 from the Japanese Patent Office issued in corresponding Application No. 2013-003459.

* cited by examiner

*Primary Examiner* — Daniel J Colilla
*Assistant Examiner* — Ruben Parco, Jr.
(74) *Attorney, Agent, or Firm* — Sughrue Mion, PLLC

(57) ABSTRACT

An image forming apparatus includes an intermediate transfer belt that transports a toner image, a second transfer member that performs second transfer that transfers the toner image on the intermediate transfer belt to a recording medium, an opposed member that is opposed to the second transfer member, a recording medium guide member that guides one surface of the recording medium to a second transfer position, and a holding member that is rotatably arranged in contact with an inner peripheral surface of the intermediate transfer belt so as to satisfy the following relationship: $L2/L1 \leq 0.5$ or about 0.5, where L1 is a distance between the second transfer position and a distal end of the recording medium guide member, and L2 is a distance between the second transfer position and a contact position of the holding member with the inner peripheral surface of the intermediate transfer belt.

3 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2013-003459 filed Jan. 11, 2013.

BACKGROUND

Technical Field

The present invention relates to an image forming apparatus.

SUMMARY

According to an aspect of the invention, there is provided an image forming apparatus including an intermediate transfer belt that is stretched by multiple rollers, the intermediate transfer belt transporting a toner image on an outer peripheral surface, a second transfer member that performs second transfer, the second transfer transferring the toner image on the intermediate transfer belt to a recording medium, an opposed member that abuts against an inner peripheral surface of the intermediate transfer belt, the opposed member being opposed to the second transfer member, a recording medium guide member that guides one surface of the recording medium to a second transfer position, the second transfer position being a position where the second transfer member abuts against the opposed member with the intermediate transfer belt being sandwiched between the second transfer member and the opposed member, and a holding member that is located on an upstream side of the second transfer position with respect to a movement direction of the intermediate transfer belt, the holding member being rotatably arranged in contact with an inner peripheral surface of the intermediate transfer belt so as to satisfy the following relationship: $L2/L1 \leq 0.5$ or about 0.5, where L1 is a distance between the second transfer position and a distal end of the recording medium guide member, and L2 is a distance between the second transfer position and a contact position of the holding member with the inner peripheral surface of the intermediate transfer belt.

BRIEF DESCRIPTION OF THE DRAWINGS

Exemplary embodiment of the present invention will be described in detail based on the following figures, wherein.

DETAILED DESCRIPTION

Next, the present invention will be described in further detail with reference to the figures, by way of its exemplary embodiment and specific examples. However, the present invention is not limited to the exemplary embodiment and specific examples.

It should be noted that in the following description made with reference to the figures, the figures are for illustrative purposes only, and the ratios among various dimensions and the like differ from the actuality. For the ease of understanding, components other than those required for explanation are not illustrated as appropriate.

Figure 1:
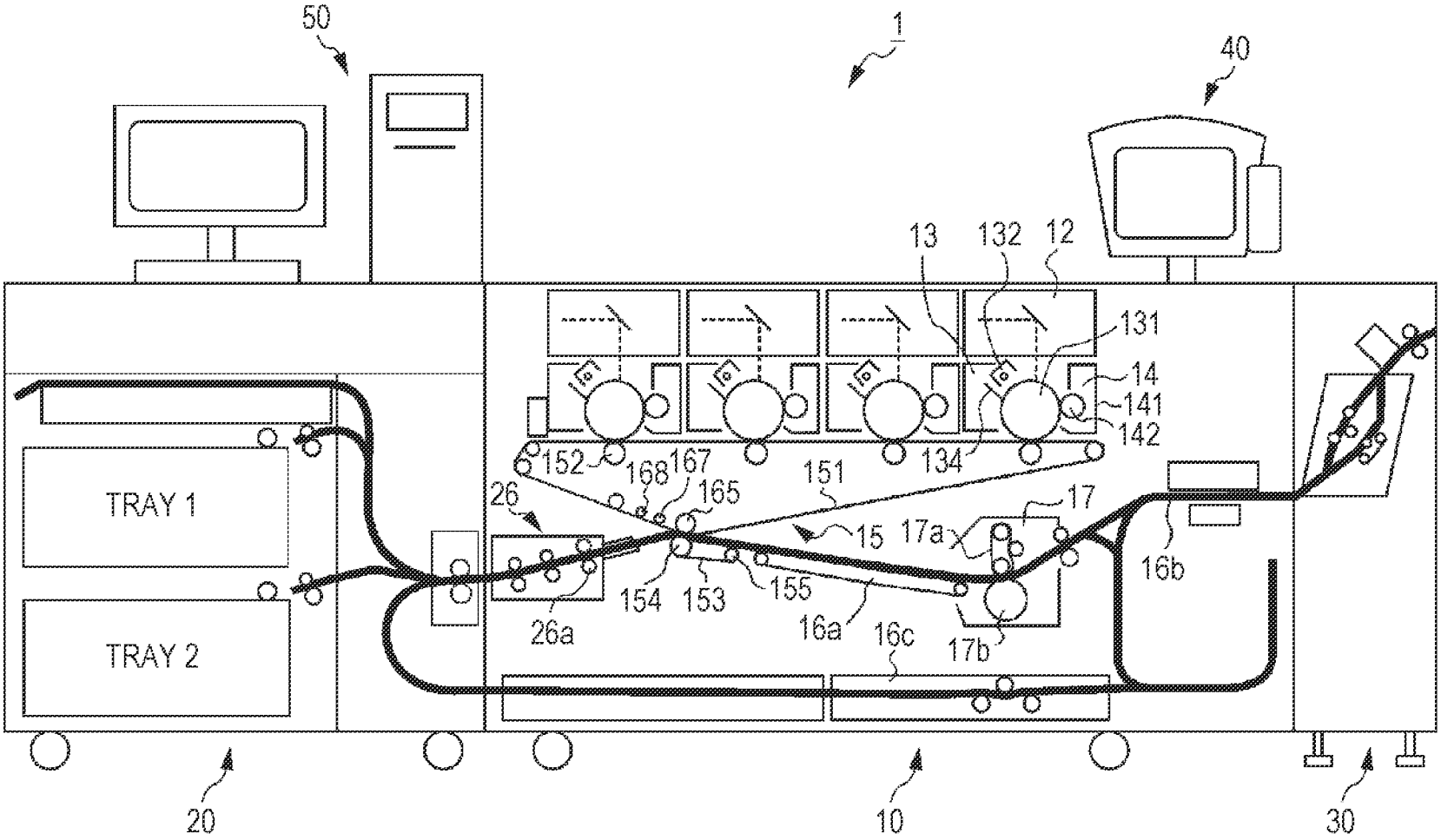
FIG. 1 is a schematic cross-sectional view illustrating an example of a general configuration of an image forming apparatus.

(1) Overall Configuration and Operation of Image Forming Apparatus (1.1) Overall Configuration of Image Forming Apparatus FIG. 1 is a schematic cross-sectional view illustrating an example of a general configuration of an image forming apparatus 1 according to an exemplary embodiment of the present invention.

The image forming apparatus 1 includes an image forming unit 10, a paper feed device 20 that is mounted to one end of the image forming unit 10, a paper discharge unit 30 that is provided at the other end of the image forming unit 10 and from which printed paper is discharged, an operational information unit 40, and an image processing unit 50 that generates image information from print information transmitted from a host apparatus.

The image forming unit 10 includes a system controller 11, an exposure device 12, photoconductor units 13, developing devices 14, a transfer device 15, paper transport devices 16*a*, 16*b*, and 16*c*, a fixing device 17, and a driving device 18. The image forming unit 10 forms image information received from the image processing unit 50, as a toner image on paper P fed from the paper feed device 20.

The paper feed device 20 supplies paper to the image forming unit 10. That is, the paper feed device 20 includes multiple paper loading units that receive different types (for example, material, thickness, paper size, and paper grain) of paper P. The paper feed device 20 supplies the paper P sent out from one of these multiple paper loading units to the image forming unit 10.

The paper discharge unit 30 discharges the paper P to which an image has been outputted in the image forming unit 10. For this reason, the paper discharge unit 30 is provided with a discharge paper receiving unit to which the paper P that has undergone image output is discharged. The paper discharge unit 30 may have the function of performing post-processing such as cutting or stapling on a bundle of paper outputted from the image forming unit 10.

The operational information unit 40 is used for inputting various settings and instructions, and displaying information. That is, the operational information unit 40 corresponds to a so-called user interface. Specifically, the operational information unit 40 is configured by a combination of a liquid crystal display panel, various operating buttons, a touch panel, and the like.

(1.2) Configuration and Operation of Image Forming Unit

In the image forming apparatus 1 configured as described above, in synchronism with the timing of image formation, each single sheet of the paper P to be printed by a print job sent out from a specified paper loading unit of the paper feed device 20 is fed to the image forming unit 10.

The photoconductor units 13 are provided in parallel below the exposure device 12. Each of the photoconductor units 13 includes a photoconductor drum 131. The photoconductor drum 131 serves as an image carrier that is rotationally driven. A charger 132, the exposure device 12, the developing device 14, a first transfer roller 152, and a cleaning blade 134 are arranged along the rotational direction of the photoconductor drum 131.

Each of the developing devices 14 has a developing housing 141 in which a developer is received. A developing roller 142 opposed to the photoconductor drum 131 is disposed inside the developing housing 141. A layer regulating member (not illustrated) that regulates the layer thickness of developer is arranged in close proximity to the developing roller 142.

The developing devices 14 are configured in substantially the same manner except for the developer received in the corresponding developing housing 141. The developing devices 14 form toner images of yellow (Y), magenta (M), cyan (C), and black (B), respectively.

The surface of the photoconductor drum 131 that rotates is charged by the charger 132. An electrostatic latent image is formed on the surface of the photoconductor drum 131 by latent image-forming light emitted from the exposure device 12. The electrostatic latent image formed on the photoconductor drum 131 is developed as a toner image by the developing roller 142.

The transfer device 15 includes an intermediate transfer belt 151, the first transfer roller 152, and a second transfer belt 153. Toner images of various colors formed on the photoconductor drums 131 of the respective photoconductor units 13 are transferred to the intermediate transfer belt 151 in multiple layers. The first transfer roller 152 sequentially transfers the toner images of various colors formed in the photoconductor units 13 to the intermediate transfer belt 151 (first transfer). The second transfer belt 153 transfers the toner images of various colors that have been transferred onto the intermediate transfer belt 151 in a superimposed manner, to the paper as a recording medium at once (second transfer).

The second transfer belt 153 is stretched by the second transfer roller 154 and a peeling roller 155. The second transfer belt 153 is sandwiched between a backup roller 165 arranged on the back side of the intermediate transfer belt 151, and the second transfer roller 154, thus forming a second transfer part (TR).

The toner images of various colors formed on the photoconductor drums 131 of the respective photoconductor units 13 are electrostatically transferred onto the intermediate transfer belt 151 sequentially (first transfer) by the first transfer roller 152 to which a predetermined transfer voltage is applied from a power supply device (not illustrated) controlled by the system controller 11, thereby forming superimposed toner images on which various colors of toner are superimposed.

As the intermediate transfer belt 151 moves, the superimposed toner images on the intermediate transfer belt 151 are transported to a region (second transfer part TR) where the second transfer belt 153 is arranged. Once the superimposed toner images are transported to the second transfer part TR, the paper P is supplied to the second transfer part TR from the paper feed device 20 in synchronism with this timing. Then, a predetermined transfer voltage is applied to the backup roller 165 that is opposed to the second transfer roller 154 with the second transfer belt 153 therebetween, from the power supply device or the like controlled by the system controller 11, and the multilayer toner images on the intermediate transfer belt 151 are transferred onto the paper P at once.

Residual toner on the surface of the photoconductor drum 131 is removed by the cleaning blade 134, and recovered to a waste toner receiving unit (not illustrated). The surface of the photoconductor drum 131 is charged by the charger 132 again.

The fixing device 17 includes an endless fixing belt 17*a* that rotates in one direction, and a pressure roller 17*b* that contacts the peripheral surface of the fixing belt 17*a* and rotates in one direction. A nip part (fixing region) is formed by the press contact region between the fixing belt 17*a* and the pressure roller 17*b*.

The paper P with the toner image transferred in the transfer device 15 is transported to the fixing device 17 via the paper transport device 16*a* in a state in which the toner image has not been fixed yet. The toner image is fixed onto the paper P transported to the fixing device 17 with pressure and heat applied by the pair of the fixing belt 17*a* and the pressure roller 17*b*.

The paper P with the fixed toner image is fed to the paper discharge unit 30 via the paper transport device 16*b*.

In the case of outputting an image onto both sides of the paper P, the front and back sides of the paper P are reversed by the paper transport device 16*c*, and the paper P is fed to the second transfer part TR of the image forming unit 10 again. Then, after a toner image is transferred and the transferred image is fixed onto the paper P, the paper P is fed to the paper discharge unit 30. The paper P fed to the paper discharge unit 30 undergoes post-processing such as cutting or stapling as required, before being discharged to the discharge paper receiving unit.

Figure 2:
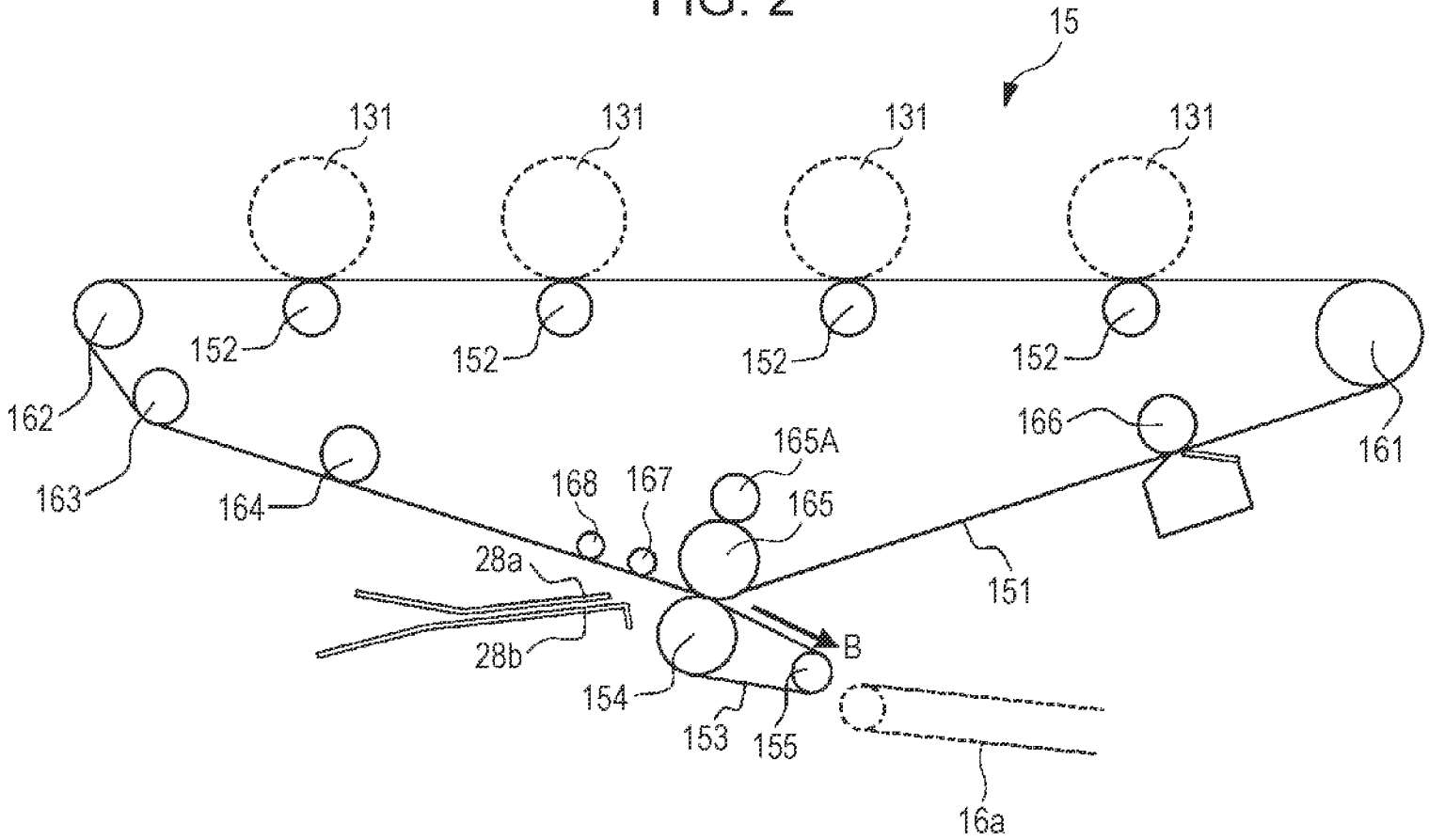
FIG. 2 is a schematic cross-sectional view illustrating a configuration of a transfer device of the image forming apparatus.

(2) Configuration and Action of Transfer Device (2.1) Configuration of Transfer device FIG. 2 is a schematic cross-sectional view illustrating a configuration of the transfer device 15 of the image forming apparatus 1 according to the exemplary embodiment.

The transfer device 15 includes the intermediate transfer belt 151, the first transfer roller 152, and the second transfer belt 153.

The intermediate transfer belt 151 used is made of resin such as polyimide or polyamide containing a suitable amount of conductive agent such as carbon black, and has a volume resistivity of $10^6$ to $10^{14}$ Ω·cm. The intermediate transfer belt 151 is formed as an endless belt in a film-like form with a thickness of, for example, about 0.1 mm.

The intermediate transfer belt 151 has a driving roller 161, a driven roller 162, a tension roller 163, a support roller 164, the backup roller 165, and a cleaning backup roller 166. The driving roller 161 drives the intermediate transfer belt 151 so as to circulate. The driven roller 162 supports the intermediate transfer belt 151 that extends in a substantially straight line along the arrangement direction of the photoconductor drums 131. The tension roller 163 applies a predetermined tension to the intermediate transfer belt 151 and prevents meandering of the intermediate transfer belt 151. The support roller 164 is provided on the upstream side of the second transfer part TR, and supports the intermediate transfer belt 151. The backup roller 165 is provided in the second transfer part TR. The cleaning backup roller 166 is provided in a cleaning part that scrapes off residual toner on the intermediate transfer belt 151.

The backup roller 165 is a blended rubber tube of EPDM and NBR with carbons dispersed on its surface. The inside of the backup roller 165 is made of EPDM rubber. The backup roller 165 has a surface resistivity of $10^7$ to $10^{10}$ Ω/sq and a roller diameter of 28 mm. The hardness of the backup roller 165 is set to, for example, 70 degrees (Asker-C).

The backup roller 165 is arranged on the back side of the intermediate transfer belt 151, and forms a counter electrode for the second transfer belt 153. A power supply roller 165A made of metal is arranged in contact with the backup roller 165. The power supply roller 165A applies a bias voltage for forming a second transfer electric field in the second transfer part TR.

The first transfer roller 152 is opposed to each of the photoconductor drums 131 with the intermediate transfer belt 151 therebetween. The first transfer roller 152 is applied with a voltage of a polarity opposite to the polarity in which toner is charged. Consequently, toner images on the photoconductor drums 131 are electrostatically attracted to the intermediate transfer belt 151 sequentially, thereby forming superimposed toner images on the intermediate transfer belt 151.

The second transfer belt 153 is a semi-conductive endless annular belt that is made of resin such as polyimide or polyamide containing a suitable amount of conductive agent such as carbon black, and whose volume resistivity is adjusted to, for example, $10^6$ to $10^{10}$ Ω·cm. As illustrated in FIG. 2, the second transfer belt 153 is stretched by the second transfer roller 154 and the peeling roller 155, and is applied with a predetermined tension in advance. Further, in the exemplary embodiment, the second transfer belt 153 receives a driving force from the second transfer roller 154, and rotates in the direction of an arrow B in FIG. 2 at a predetermined speed.

The second transfer roller 154 is made of semi-conductive rubber with a volume resistivity of, for example, $10^6$ to $10^{10}$ Ω·cm. The second transfer roller 154 is opposed to the backup roller 165 with the second transfer belt 153 and the intermediate transfer belt 151 therebetween. The second transfer roller 154 forms the second transfer part TR together with the backup roller 165 where a toner image carried by the intermediate transfer belt 151 is transferred (second transfer) to the paper P being transported on the second transfer belt 153.

Further, a driving motor (not illustrated) is connected to the second transfer roller 154. As the second transfer roller 154 receives a rotational drive force from the driving motor, the second transfer roller 154 rotates, and further causes the second transfer belt 153 to rotate.

The second transfer roller 154 is fixed in position by the frame (not illustrated) of the transfer device 15. The backup roller 165 is rotatably supported by a bearing part (not illustrated) provided to a holding member 170.

The backup roller 165 is urged by a moving mechanism (not illustrated) toward the second transfer roller 154 via the second transfer belt 153, in a constant displacement state according to the basis weight of the paper P. A nip part is formed over a predetermined width between the second transfer roller 154 and the backup roller 165.

Figure 3A:
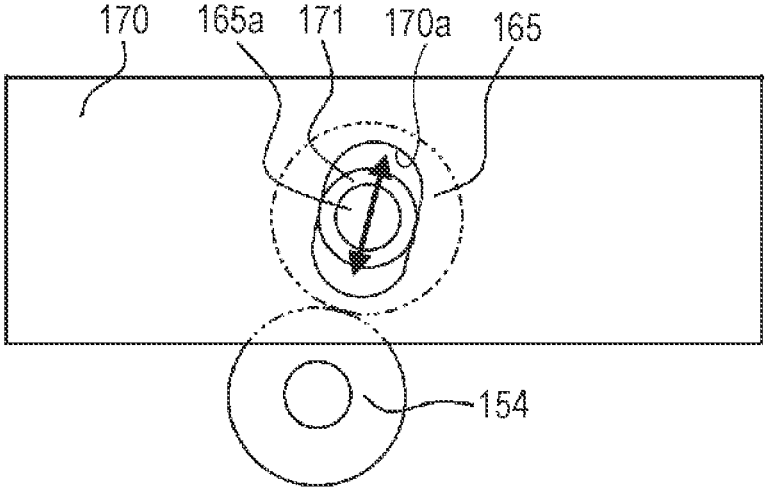
FIGS. 3A and 3B are schematic diagrams each illustrating an example of a moving mechanism for a backup roller that constitutes the transfer device.
Figure 3B:
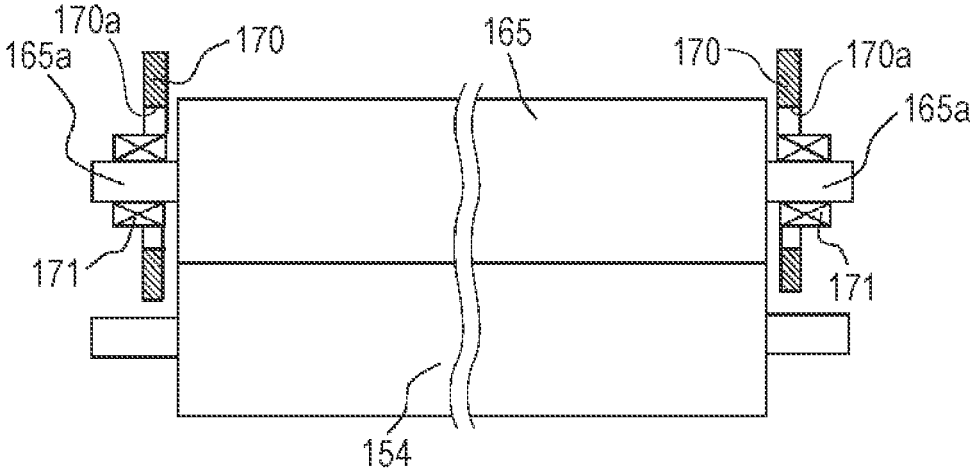

FIGS. 3A and 3B are schematic diagrams each illustrating an example of the moving mechanism for the backup roller 165.

The backup roller 165 is attached to the holding member 170. A rotating shaft 165*a* is provided at either end portion in the axial direction (direction orthogonal to the paper transport direction) of the backup roller 165. The rotating shaft 165*a* is rotatably supported on a bearing 171 that is provided inside the holding member 170.

The bearing 171 is slidably supported in an elongated hole 170*a*. The elongated hole 170*a* is formed so as to penetrate either side wall portion of the holding member 170. As a first eccentric cam plate (not illustrated) is rotationally driven by the driving motor (not illustrated), the bearing 171 moves in the direction of the longitudinal diameter axis of the elongated hole 170*a*. The longitudinal diameter of the elongated hole 170*a* is in the same direction as the imaginary normal to the transfer nip which connects the center of the backup roller 165 and the center of the second transfer roller 154 at the second transfer position.

That is, the backup roller 165 is movable inside the holding member 170 so as to come into abutment with the second transfer roller 154.

As illustrated in FIG. 2, the peeling roller 155 is located on the downstream side of the second transfer roller 154 with respect to the rotational direction (direction of the arrow B in FIG. 2) of the second transfer belt 153. The peeling roller 155 and the second transfer roller 154 form a belt surface for transporting the paper P to the downstream side.

Further, in order to peel the paper P from the surface of the second transfer belt 153, the roller diameter of the peeling roller 155 is set to less than or equal to half the roller diameter of the second transfer roller 154.

A paper guide 28 is arranged on the upstream side of the second transfer part TR of the transfer device 15. The paper guide 28 is opposed to the toner image-carrying surface of the intermediate transfer belt 151, and guides the paper P to the second transfer part TR.

The paper guide 28 includes a paper guide 28*a* that guides the upper surface (transfer surface) of the paper P, and a paper guide 28*b* that guides the lower surface (non-transfer surface) of the paper P.

The intermediate transfer belt 151, the backup roller 165, and the second transfer roller 154 opposed to the backup roller 165 with the second transfer belt 153 therebetween are arranged so that the intermediate transfer belt 151 and the tangent to the transfer nip (hereinafter simply referred to as "transfer nip tangent") form an angle greater than or equal to 10° or about 10° to each other toward the paper P. The transfer nip tangent is orthogonal to the normal to the transfer nip (hereinafter simply referred to as transfer nip normal) which connects the center of the backup roller 165 and the center of the second transfer roller 154.

Movement preventing rollers 167 and 168 are provided upstream of the second transfer part TR and downstream of the support roller 164, on the inner side of the intermediate transfer belt 151. The movement preventing rollers 167 and 168 are rotatably arranged in contact with the inner surface of the intermediate transfer belt 151.

Specifically, the movement preventing rollers 167 and 168 are rotatably supported by the bearing 171 provided to the holding member 170 for the backup roller 165. The movement preventing rollers 167 and 168 are slidably supported in such a way that the movement preventing rollers 167 and 168 so as to be in contact with the inner side of the intermediate transfer belt 151 by the moving mechanism (not illustrated), together with the holding member 170.

The movement preventing roller 167 located closest to the second transfer part TR is arranged so as to satisfy the following relationship: $L2/L1 \leq 0.5$ or about 0.5, where L2 is the distance between the position of the nip (hereinafter, referred to as transfer position P1) formed in the second transfer part TR by the backup roller 165 and the second transfer roller 154 with the second transfer belt 153 therebetween, and a contact point P2 of the movement preventing roller 167 and the inner surface of the intermediate transfer belt 151, and L1 is the distance between the transfer position P1 and a distal end P3 of the paper guide 28*a* for the paper P in the second transfer part TR.

Further, the distance L1 between the transfer position P1 and the distal end P3 of the paper guide 28*a* for the paper P in the second transfer part TR is set to 20 mm or about 20 mm to 40 mm or about 40 mm.

(2.2) Action of Transfer Device

Figure 4:
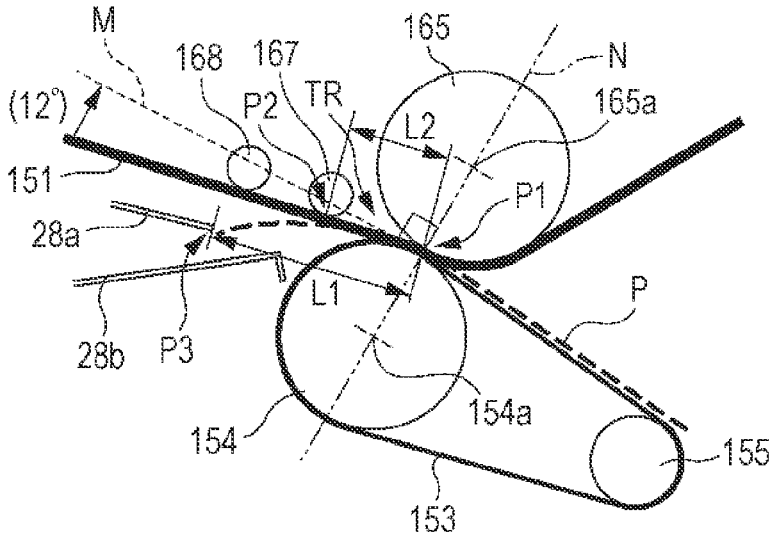
FIG. 4 is a schematic cross-sectional view of the major portion of the transfer device including a paper guide of the image forming apparatus.

FIG. 4 is a schematic cross-sectional view of the major portion of the transfer device 15 including the paper guide 28 of the image forming apparatus 1 configured as mentioned above.

Hereinafter, the action of the transfer device 15 will be described with reference to FIG. 4.

A toner image formed on the photoconductor drum 131 of each of the photoconductor units 13 is transferred onto the intermediate transfer belt 151 in a first transfer part where each of the photoconductor drums 131 and the intermediate transfer belt 151 are opposed to each other. The unfixed toner image that has undergone the first transfer is transported to the second transfer part TR as the intermediate transfer belt 151 rotates.

The paper feed device 20 supplies the paper P of a predetermined size in synchronism with the timing of image formation. The paper P supplied by the paper feed device 20 reaches the second transfer part TR via an orientation correcting unit 26. The paper P is temporarily stopped, and registration rollers 26*a* are rotated in synchronism with the movement timing of the intermediate transfer belt 151 carrying the toner image, thereby performing registration between the paper P and the toner image.

Then, the paper P transported in a synchronized manner is nipped in the second transfer part TR formed between the intermediate transfer belt 151 and the second transfer belt 153. The power supply roller 165A forms a transfer electric field by applying a voltage of the same polarity as the polarity in which toner is charged. The transfer electric field thus formed causes the unfixed toner image carried on the intermediate transfer belt 151 to be electrostatically transferred to the paper P, in the second transfer part TR formed by the second transfer roller 154 and the backup roller 165.

Thereafter, the paper P with the electrostatically transferred toner image is transported to the downstream side by the second transfer belt 153, and upon reaching the position of the peeling roller 155, the paper P is peeled from the second transfer belt 153.

Then, the paper P is transported by the paper transport device 16*a* that is provided on the downstream side of the transport direction. The paper transport device 16*a* transports the paper P to the fixing device 17 at a speed suited to a fixing process in the fixing device 17. The fixing device 17 performs a fixing process by application of heat and pressure, thereby fixing the unfixed toner image on the paper P onto the paper P. Then, the paper P with the fixed image is discharged to the paper discharge unit 30 by the paper transport device 16*a*. Residual toner that remains on the intermediate transfer belt 151 after transfer of the image to the paper P is finished is removed by a belt cleaner (not illustrated).

In the image forming apparatus 1, toner images are formed on the paper P with a wide variety of paper attributes. In particular, for example, in the case of the paper P having a basis weight of 300 g/m$^2$ to 450 g/m$^2$, when the trailing edge of the paper P comes into contact with the intermediate transfer belt 151, a streak-like image disturbance occurs in the image being transferred in the second transfer part TR in some cases.

When the trailing edge of the paper P passes the distal end of the paper guide 28*a* that guides the upper surface (transfer surface) of the paper P, a force is applied to the paper P in the direction of the transfer nip normal N that connects the center of the backup roller 165 and the center of the second transfer roller 154. In a case where the paper P used has a large thickness and thus has increased stiffness, the force acting in the direction of the transfer nip normal N becomes an impact force when the trailing edge collides against the surface of the intermediate transfer belt 151. It is assumed that this impact force is transmitted to the transfer position P1, causing a streak-like image disturbance to occur in the image being transferred (see FIG. 5).

Figure 5:
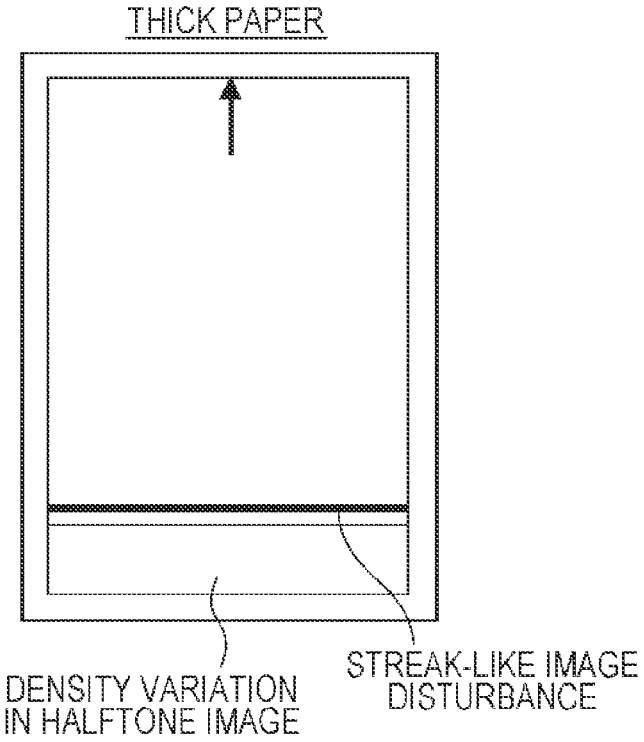
FIG. 5 is a schematic diagram illustrating an example of the image disturbance to be addressed by an exemplary embodiment of the present invention.

As the intermediate transfer belt 151 and the paper P vibrate owing to this impact force, a minute gap formed between the surfaces of the intermediate transfer belt 151 and second transfer belt 153 in a region located upstream of a region where the second transfer roller 154 and the backup roller 165 are strongly pressed against each other changes, with the result that the second transfer electric field becomes unstable, causing an image disturbance (density variation in a halftone image or the like) to occur in the trailing edge portion of the paper in some cases (see FIG. 5).

In the image forming apparatus 1 according to the exemplary embodiment, on the upstream side of the second transfer part TR and on the downstream side of the support roller 164, the movement preventing rollers 167 and 168 are rotatably arranged on the inner side of the intermediate transfer belt 151 while being in contact with the inner surface of the intermediate transfer belt 151.

Moreover, the movement preventing roller 167 located closest to the second transfer part TR is arranged so as to satisfy the following relationship: $L2/L1 \leq 0.5$ or about 0.5, where L2 is the distance between the transfer position P1 and the contact point P2 of the movement preventing roller 167 and the inner surface of the intermediate transfer belt 151, and L1 is the distance between the transfer position P1 and the distal end P3 of the paper guide 28*a*.

Consequently, even when the trailing edge of the paper P passes the distal end of the paper guide 28*a* and comes into contact with the intermediate transfer belt 151, the intermediate transfer belt 151 is unlikely to move to the inner side owing to the movement preventing rollers 167 and 168, and thus vibration of the intermediate transfer belt 151 is reduced.

Therefore, vibration of the intermediate transfer belt 151 due to the impact force exerted when the trailing edge of the paper P collides against the surface of the intermediate transfer belt 151 is attenuated at the contact point P2 between the movement preventing roller 167 and the inner surface of the intermediate transfer belt 151, and transmission of this vibration to the transfer position P1 is reduced, thereby preventing a streak-like image disturbance from occurring in the image being transferred.

In a region located in immediate proximity to and upstream of a region where the second transfer roller 154 and the backup roller 165 are strongly pressed against each other, a minute gap is formed between the surfaces of the intermediate transfer belt 151 and second transfer belt 153. Because changes in the gap in this region are reduced, and the second transfer electric field becomes stable, an image disturbance in the trailing edge portion of the paper is prevented.

The distance L1 between the transfer position P1 and the distal end P3 of the paper guide 28*a* for the paper P in the second transfer part TR is set to 20 mm or about 20 mm to 40 mm or about 40 mm. If the distance L1 between the transfer position P1 and the distal end P3 of the paper guide 28*a* for the paper P is set smaller than about 20 mm, that is, if the distal end P3 of the paper guide 28*a* is brought unnecessarily close to the transfer position P1, an image disturbance may occur as the transfer surface of the paper P transported to the second transfer part TR and the toner image carried on the intermediate transfer belt 151 rub against each other.

If the distance L1 between the transfer position P1 and the distal end P3 of the paper guide 28*a* for the paper P is set larger than about 40 mm, that is, if the distal end P3 of the paper guide 28*a* is unnecessarily spaced apart from the transfer position P1, the distance between the transfer position P1 and the trailing edge of the paper increases, with the result that a slight slip occurs between the paper P and the intermediate transfer belt 151, which may cause image smear.

The movement preventing roller 167 located closest to the transfer position P1 is arranged so as to satisfy the relationship L2/L1≤0.5 or about 0.5. The distance L1 between the transfer position P1 and the distal end P3 of the paper guide 28*a* of the paper P is set to 20 mm or about 20 mm to 40 mm or about 40 mm. That is, the movement preventing roller 167 is arranged so as to keep the distance to the transfer position P1 not more than 20 mm, and make the position of the side of the belt upstream of the transfer position P1 stable, thereby ensuring ease of transfer.

Moreover, the intermediate transfer belt 151, the backup roller 165, and the second transfer roller 154 opposed to the backup roller 165 with the second transfer belt 153 therebetween are arranged so that the intermediate transfer belt 151 and a transfer nip tangent M orthogonal to the transfer nip normal N connecting the center of the backup roller 165 and the center of the second transfer roller 154 form an angle greater than or equal to 10° or about 10° to each other toward the paper P.

Consequently, the distance between the distal end of the paper guide 28*a* and the surface of the intermediate transfer belt 151 is short, and the impact force generated when the trailing edge of the paper P collides against the surface of the intermediate transfer belt 151 becomes small.

While the exemplary embodiment of the present invention has been described in detail above, the present invention is not limited to the exemplary embodiment mentioned above but various modifications are possible within the scope of the present invention as defined by the claims.

For example, while the image forming apparatus 1 according to the exemplary embodiment has been described as a tandem color printer using an intermediate transfer belt which employs a second transfer belt system, the present invention is also applicable to an image forming apparatus employing a second transfer roller system which does not have a second transfer belt.

What is claimed is:

1. An image forming apparatus comprising:

an intermediate transfer belt that is stretched by a plurality of rollers, the intermediate transfer belt being configured to transport a toner image on an outer peripheral surface;

a second transfer member configured to perform a second transfer, the second transfer transferring the toner image on the intermediate transfer belt to a recording medium;

an opposed member that abuts against an inner peripheral surface of the intermediate transfer belt, the opposed member being opposed to the second transfer member;

a recording medium guide member configured to guide one surface of the recording medium to a second transfer position, the second transfer position being a position where the second transfer member abuts against the opposed member with the intermediate transfer belt being sandwiched between the second transfer member and the opposed member; and a holding member that is located on an upstream side of the second transfer position with respect to a movement direction of the intermediate transfer belt, the holding member having a curved surface, wherein the curved surface is in contact with the inner peripheral surface of the intermediate transfer belt so as to satisfy the following relationship: L2/L1≤0.5, where L1 is a distance between the second transfer position and a distal end of the recording medium guide member, and L2 is a distance between the second transfer position and a contact position of the holding member with the inner peripheral surface of the intermediate transfer belt, wherein no portion of the inner peripheral surface of the intermediate transfer belt, between the second transfer position and the contact position of the holding member, contacts any members, wherein the distance L1 between the second transfer position and the distal end of the recording medium guide member is 20 mm≤L1≤40 mm.

2. The image forming apparatus according to claim 1, wherein on the upstream side of the second transfer position with respect to the movement direction of the intermediate transfer belt, the intermediate transfer belt is arranged at an angle greater than or equal to 10° toward the recording medium being transported, with respect to a tangent orthogonal to an imaginary normal that connects a center of the opposed member and a center of the second transfer member at the second transfer position.

3. The image forming apparatus according to claim 1, wherein the recording medium guide member is configured to guide the one surface onto which the toner image is transferred.

* * * * *